United States Patent [19]

Wiesmann et al.

[11] 4,432,582

[45] Feb. 21, 1984

[54] CHAIR WITH MEANS FOR ADJUSTING THE INCLINATION OF THE BACKREST

[75] Inventors: Herbert L. Wiesmann, Hameln; Erich W. Becker, Springe, both of Fed. Rep. of Germany

[73] Assignee: Wilkhahn-Wilkening & Hahne GmbH & Company, Bad Munder, Fed. Rep. of Germany

[21] Appl. No.: 331,790

[22] Filed: Dec. 17, 1981

[51] Int. Cl.[3] ..... A47C 1/02

[52] U.S. Cl. ..... 297/316; 297/300; 297/328; 297/410; 297/353

[58] Field of Search ..... 297/300, 301, 383, 410, 297/353, 354, 355, 313, 316, 328

[56] References Cited

U.S. PATENT DOCUMENTS

| | | | |
|---|---|---|---|
| 3,720,443 | 3/1973 | Mourgue | 297/353 |
| 3,854,772 | 12/1974 | Abrahamson et al. | 297/353 |
| 3,858,935 | 1/1975 | Pask | 297/353 |
| 4,076,308 | 2/1978 | Slabon et al. | 297/313 |
| 4,102,549 | 7/1978 | Morrison et al. | 297/410 |
| 4,170,382 | 10/1979 | Wheeler | 297/353 |

*Primary Examiner*—Francis K. Zugel

*Attorney, Agent, or Firm*—Antonelli, Terry & Wands

[57] ABSTRACT

A chair which includes a seat portion and a backrest portion as well as a support member for supporting the seat portion. A cylinder piston assembly enables an adjustment of an inclination of the backrest portion with respect to the seat portion, the seat portion is mounted at the support member so as to fix a normal setting of inclination between the seat portion and backrest portion. A first end of the cylinder piston assembly is mounted to the backrest portion by way of a bearing shaft. The bearing shaft is mounted to the chair so as to enable the bearing shaft to be easily removed. A second end of the cylinder-piston assembly is connected to the chair by way of a coupling member which extends transversely of the seat portion. The coupling member includes a pair of axially spaced end portions in which are respectively arranged coaxially disposed bearings adapted to accommodate bearing support pins. The coupling member is constructed so as to enable a removal thereof from the bearing support pins after a removal of the bearing shaft.

34 Claims, 15 Drawing Figures

CHAIR WITH MEANS FOR ADJUSTING THE INCLINATION OF THE BACKREST

The present invention relates to a piece of furniture and, more particularly, to a chair having a single support column or pedestal on which is mounted a support member for supporting a seat portion, with an adjusting means including a pneumatic cylinder and piston assembly being provided for enabling an adjustment of the backrest portion with respect to the seat portion.

A chair of the aforementioned type is proposed in, for example, U.S. Pat. No. 4,076,308, wherein a pneumatic cylinder-piston assembly is provided for coupling a seat portion to a backrest portion so as to enable the backrest portion to be inclined in selected adjusted positions with respect to the seat portion, and with a coupling means for coupling the seat portion to the support plates so as to vary an inclination of the seat portion as the backrest portion is adjusted.

One disadvantage of the above proposed chair as well as similar chairs employing an pneumatic cylinder-piston assembly resides in the fact that the pneumatic cylinder-piston assembly which is particularly prone to wear and tear, is extremely difficult to repair or replace without special tools and/or special skills.

The aim underlying the present invention essentially resides in providing a chair of the aforementioned type which not only enables an easy replacement of a pneumatic cylinder piston assembly but which also has an infinitely variable adjustment for a depth of the seat as well as an infinitely variable adjustment for a height of the backrest portion.

In accordance with advantageous features of the present invention, a chair is provided which includes a seat portion and a backrest portion as well as a support plate mounted on a pedestal or column. A plate-shaped seat part support member is rocker mounted on the support plate with a forward area being movably connected to a front edge of an intermediate support member. The intermediate support member, extending between the seat part support member and the support plate, is pivotally mounted on the support plate. The intermediate support member is attached at a back or rear end thereof to a backrest support member, with an angle of inclination of the backrest support member being adjustable by the self-locking pneumatic cylinder-piston assembly hinged at the support plate 2. The cylinder piston assembly includes an eyelet shaped bearing at one end thereof cooperable with a bearing shaft for mounting the cylinder-piston assembly to the chair, with a transversely extending coupling member being provided for mounting a second end of the cylinder-piston assembly to the chair. The coupling member is provided with coaxially disposed pivot bearings at ends thereof. The seat part support member is mounted so as to be pivotable around a fixed pivot means at the support plate so that a primary setting for an inclination of the seat portion with respect to the backrest portion is fixed; whereas, an inclination of the seat portion and the backrest portion may be synchronously varied or adjusted by changing a length of the pneumatic cylinder-piston assembly. The bearing shaft is constructed so as to be easily removable from associated bearing shaft mounting means. The coupling member has a U-shaped configuration with the coaxially disposed pivot bearings being respectively arranged in the legs of the coupling member. The coupling member is adapted to be removed from associated support bearing means after the bearing shaft has been disassembled or removed from the bearing shaft mounting means.

In accordance with further features of the present invention, at least a portion of an axial length of the bearing shaft is provided with a threading cooperable with an interior threading provided in the bearing shaft mounting means which may, for example, include a threaded bearing sleeve or bushing.

The coupling member is, in accordance with the present invention, disposed so that its axial length extends transversely to the chair and is provided with a centrally disposed slot or recess for accommodating the support bearing means which may be formed, for example, as coaxially disposed bearing side support bolts.

In accordance with the present invention, means are provided for enabling an adjustment of a depth of the seat portion, that it, adjusting a distance between a front edge of the seat portion and the backrest portion. For this purpose, the end of the pneumatic cylinder-pistion assembly is mounted at the intermediate support and means are provided for locking the seat portion in an adjusted seat-depth position.

Advantageously, according to the present invention, the backrest member includes a pair of parallel support brackets or flanges adapted to be displacably guided in slide guides provided at the intermediate support member. The support brackets enclose the cylinder-piston assembly and one of the slide guides accommodates the locking means for locking the seat portion in the adjusted seat depth position. The locking means may, for example, be formed as a manually adjustable eccentric means adapted to clamp or lock the bracket support member between an outer surface of the eccentric means and the intermediate support member.

In accordance with still further features of the present invention, the backrest support member includes a vertical or upright profiled rod member, with a backrest, pivotally mounted on a sliding core member, being adapted to be displacably mounted on the rod member. Means are provided for enabling a clamping or locking of the backrest at infinitely adjustable positions along the length of the rod member. The backrest clamping or locking means may, for example, take the form of an eccentric mounted on the core member and adapted to cooperate with the rod member so as to lock or clamp the backrest in a height adjusted position.

It is also possible in accordance with the present invention, for the backrest support member to include two L-shaped forked backrest support members with at least one of the L-shaped backrest support members being infinitely adjustable with respect to an adjacent part of the chair and adapted to be stopped or locked in an adjusted position by a clamping device. The clamping device may, for example, include a spring loaded clamping eccentric which is adapted to be manually swung out of a fixed position through a triggering lever means in order to enable an adjustment of a height of the backrest support member.

Accordingly, it is an object of the present invention to provide an adjustable chair construction which avoids, by simple means, shortcomings and disadvantages encountered in the prior art.

Another object of the present invention resides in providing an adjustable chair which enables an easy removal and replacement of a cylinder-piston assembly interposed between a backrest portion and seat portion of the chair.

Yet another object of the present invention resides in providing a chair in which a depth of a seat portion is infinitely adjustable.

A further object of the present invention resides in providing a chair wherein a height of a backrest portion of the chair is infinitely adjustable.

A still further object of the present invention resides in providing a chair which is simple in construction and therefore relatively inexpensive to manufacture.

These and other objects, features, and advantages of the present invention will become more apparent from the following description when taken in connection with the accompanying drawings which show, for the purpose of illustration only, several embodiments in accordance with the present invention, and wherein.

Figure 1:
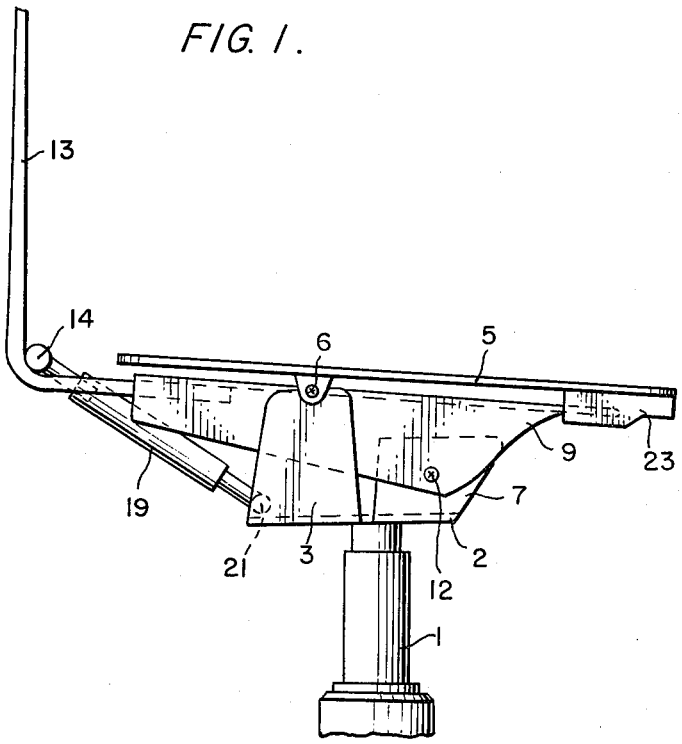
FIG. 1 is a partially schematic side view of basic components of a chair constructed in accordance with the present invention, with a backrest portion of the chair in a normal upright position.
Figure 2:
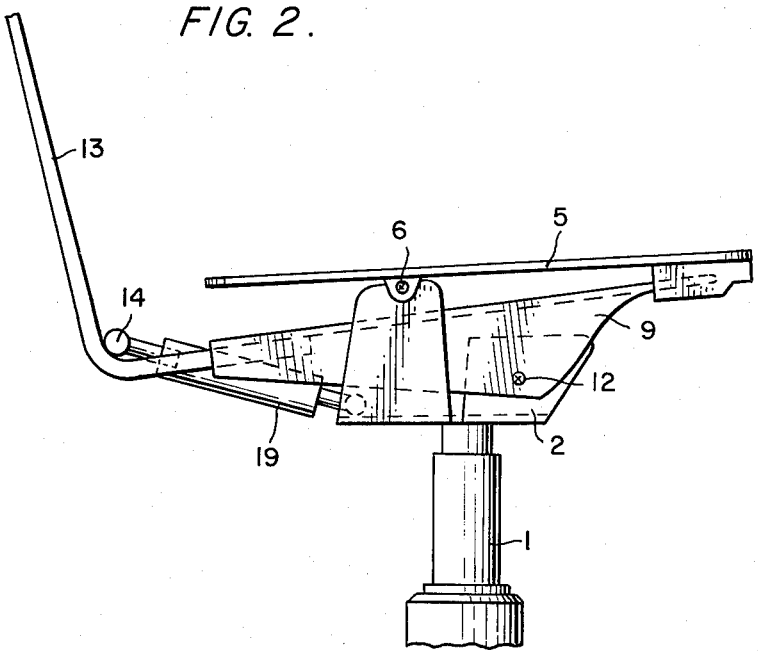
FIG. 2 is a partially schematic side view of the chair of FIG. 1, with the backrest portion in an adjusted position.

Referring now to the drawings wherein like reference numerals are used throughout the various views to designate like parts and, more particularly, to FIGS. 1–4, according to these figures, a piece of furniture such as, for example, a chair of the type proposed in, for example, U.S. Pat. No. 4,076,308, includes a single pedestal or column base 1 having a support plate 2 mounted thereon. The support plate 2 includes two upwardly bent tab or tongue portions 3, 4 in a rear area thereof and two additional upwardly bent tab or tongue portions 7, 8 in a forward area thereof. The tab or tongue portions 3, 4, and 7, 8 are disposed on respective lateral sides of the support plate 2, with a seat part support member 5 being pivotally mounted about a fixed pivot means such as, for example, a horizontally disposed shaft 6 substantially in a center area in the manner of a seesaw.

An intermediate support member 9, of U-shaped cross sectional configuration, includes two legs or webs, 10, 11. In an assembled condition of the chair, the legs 10, 11 extend downwardly and are pivotally mounted at the tab or tongue portions 7, 8 by a pivot means such as, for example, a horizontally disposed shaft 12. An L-shaped forked backrest support member generally designated by the reference numeral 13 is rigidly secured to the intermediate support member 9 in a rear area thereof. The backrest support member 13 includes two legs **13*a*, 13*b* interconnected by an angle portion 13*c*, with a bearing shaft means 14 being disposed in an area of the angle portion 13*c*. The bearing shaft means 14 is mounted in hinge bushings or sleeves 15, 16, with the sleeves or bushings 15, 16 being rigidly secured to a pair of parallel backrest support brackets 17, 18 in a lower area of the forked backrest support member 13. A self-locking pneumatic cylinder-piston assembly 19 is interposed between the support plate 2 and the bearing shaft means 14. A rear end of the cylinder-piston assembly 19 is provided with an eyelet bearing means 20 adapted to be hingedly mounted on the bearing shaft means 14, with a forward end of the cylinder-piston assembly 19 being hingedly mounted about a pivot shaft 21 provided at the support plate 2**.

Figure 3:
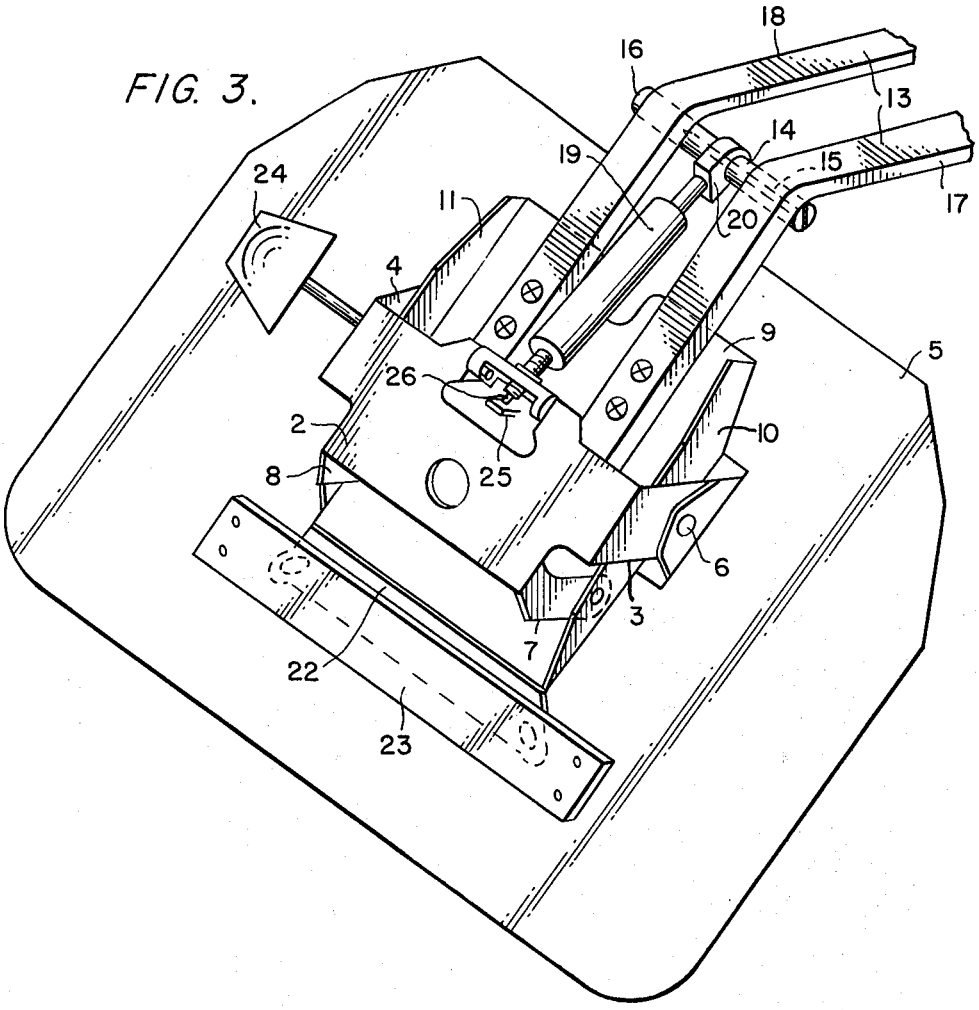
FIG. 3 is a partial bottom view of a backrest adjusting means for a chair constructed in accordance with the present invention.

As shown most clearly in FIG. 3, a tongue 22 is provided at a forward end of the intermediate support member 9, with the tongue 22 being adapted to be locked into a recess 23 located in an underside of the seat part support member 5 in a front area thereof. The tongue 22 is adapted to brace the pivotally mounted seat part support member 5 in a position imposed by the pneumatic cylinder-piston assembly 19.

The chair may be adjusted in a conventional manner by releasing the pneumatic cylinder-piston assembly through operation of a release lever 24 by which an actuation member 25 is pushed against a trigger pin 26 of the pneumatic cylinder-piston assembly 19. Upon release of the cylinder-piston assembly 19, the backrest support member 13 may be swung or pivoted from, for example, a normal upright position of FIG. 1 into any desired adjusted position such as, for example, the adjusted position illustrated in FIG. 2.

Figure 4:
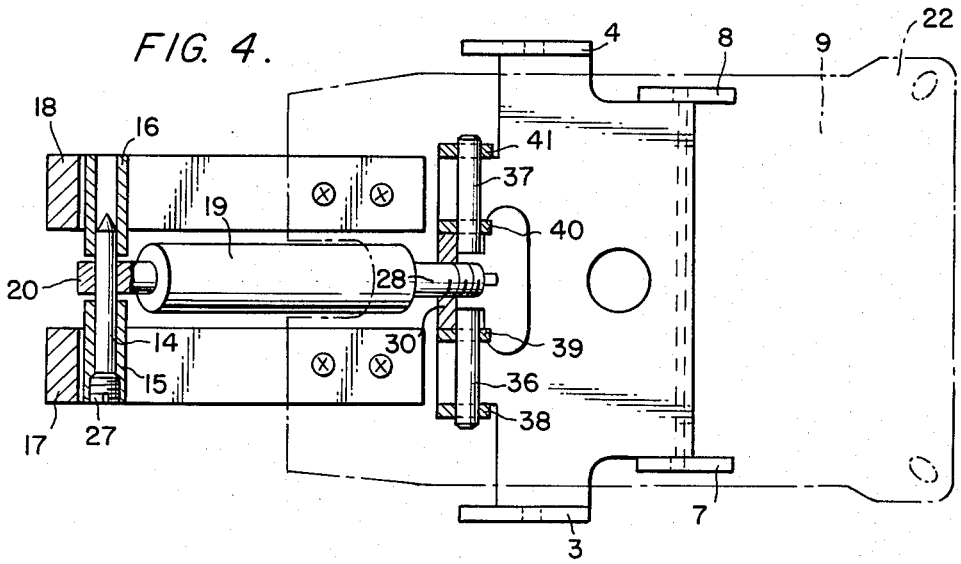
FIG. 4 is a partial cross sectional top view of the backrest adjusting means of FIG. 3, with parts removed for clarity.

To facilitate a repair and/or replacement of the pneumatic cylinder-piston assembly 19, as shown most clearly in FIG. 4, the bearing shaft means 14 has an enlarged diameter portion at one end thereof, with a headless screw 27 being formed in the enlarged diameter portion of the bearing shaft means 14. At least a front portion of the bushing or sleeve 15 is provided with an internal threading cooperable with the threads of the headless screw 27 so as to secure the bearing shaft means 14 in position. The bearing shaft means 14 may be removed from the sleeves or bushings 15, 16, and eyelet bearing means 20 by simply loosening the headless screw 27 by, for example, a wrench, screwdriver, or the like, thereby freeing the hinged rear end of the cylinder-piston assembly 19.

Figure 5:
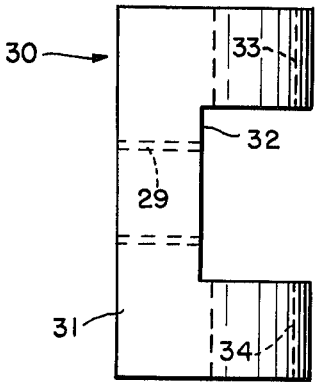
FIG. 5 is a plan view, on an enlarged scale, of a coupling means for the backrest adjusting means of the present invention.
Figure 6:
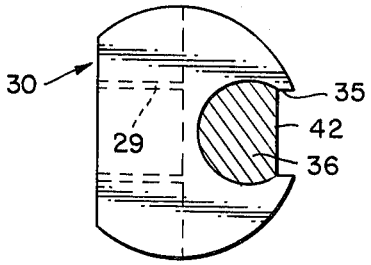
FIG. 6 is an end view of the coupling means of FIG. 5, with coupling or bearing means accommodated in the coupling means.
Figure 7:
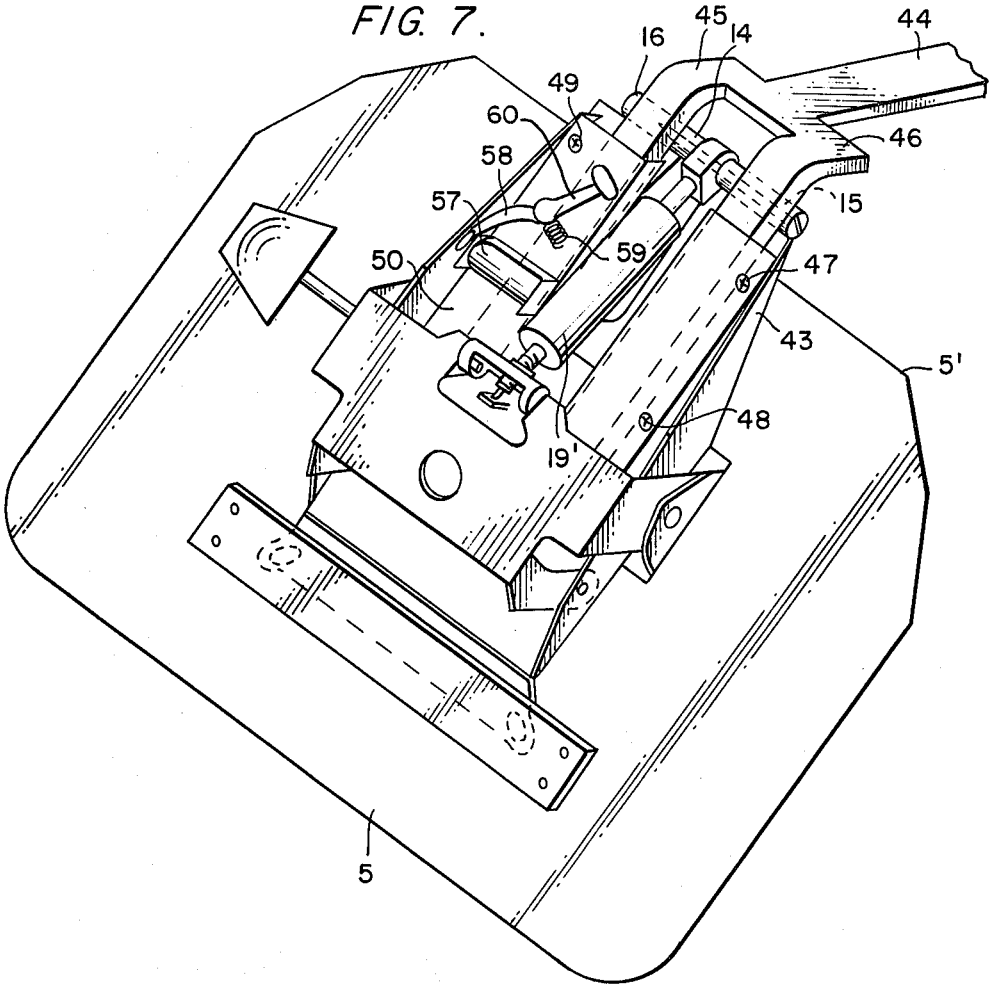
FIG. 7 is a bottom view of a seat depth adjusting means for a chair constructed in accordance with the present invention.
Figure 8:
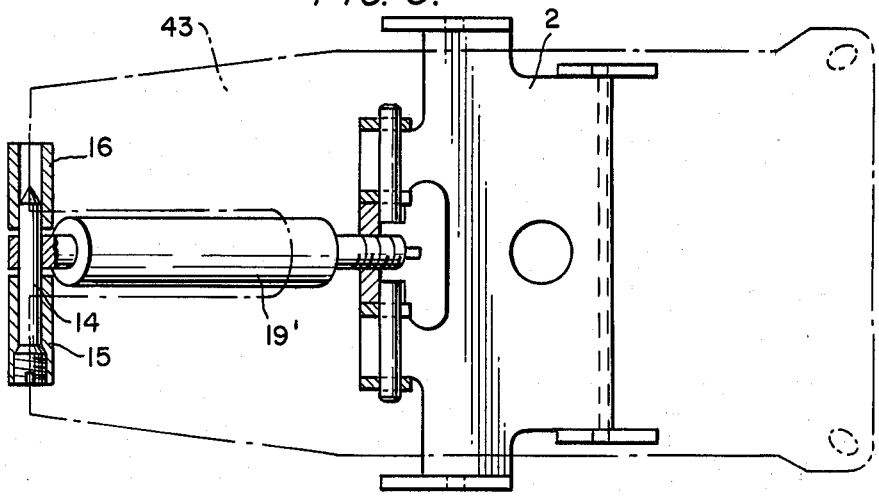
FIG. 8 is a partial cross sectional top view of FIG. 7 with parts removed for clarify.

A guide tube 28 for the trigger pin 26 is attached to a forward end of the cylinder-piston assembly 19, with the guide tube 28 being provided along an outer circumferential surface thereof with an external threading adapted to cooperate with a threaded tab hole 29 of a coupling member generally designated by the reference numeral 30 (FIGS. 5 and 6). The coupling member 30 is formed as a cylinder having a flatened side 31 and, on an opposite side 32, a central recess or slot is provided for accommodating the trigger pin 26 and actuation member 25. Two coaxially disposed bearing bores 33, 34 opening into the recess 32 extend from the front faces of the coupling member 30 to the recess 32. The bearing bores 33, 34 are open to a side facing the flatened side 31, with a diameter of an opening 35 of the central recess being slightly less than a diameter of the bearing bores 33, 34.

As shown most clearly in FIG. 4, support bolts 36, 37 project from the exterior through the bearing bores 33, 34, with the respective support bolts 36, 37 being mounted, in a manner in which they cannot be lost, in additional upwardly being tongues or tab portions 38, 39 and 40, 41 provided on the support plate 2. The support bolts 36, 37 are, as shown in FIG. 6, provided with a flattened side 42 which enables the coupling member 30 to be lifted from the support bolts 36, 37 after being turned 90° from the position illustrated in FIG. 6. Thus, after a removal of the bearing shaft means 14 in the manner described hereinabove, the pneumatic cylinder-piston assembly 19 may be swung around the support bolts 36, 37 and lifted off the support bolts 36, 37 together with the coupling piece 30 and it is equally simple to install a new pneumatic cylinder-piston assembly 19. The guide tube 28 of the pneumatic cylinder-piston assembly 19 with exterior threading makes it possible to adjust an axial length of the pneumatic cylinder-piston assembly 19 with respect to the actuation plate 25 in such a manner that the cylinder-piston assembly 19 may be operated without slipping. The guide tube 28 may, for example, be a piston rod of the pneumatic cylinder-piston assembly 19 at the same time and, in this case, the housing of the pneumatic cylinder-piston assembly 19 would be rigidly connected to the eyelet bearing means 20.

FIGS. 7–10 provide another example of a chair construction in which the pneumatic cylinder-piston assembly 19 may be easily and quickly replaced and, in addition, a depth of the seat portion, that is, a distance from an edge of the seat portion and backrest portion may be adjustable. For this purpose, an intermediate support member 43 is extended beyond a rear edge 5' of the seat part support member 5, and the hinge sleeves or bushings 15, 16 are directly attached to the intermediate support member 43. Advantageously, the hinge sleeves or bushings 15, 16, may be formed as rolled hinges made of the same sheet metal as the intermediate support member 43. A backrest support member 44 includes a pair of lower parallel support brackets 45, 46 adapted to be inserted into recesses provided on an underside of the intermediate support member 43 and secured in place by suitable fastening means such as, for example, screws 47, 48, 49, 50.

Figure 10:
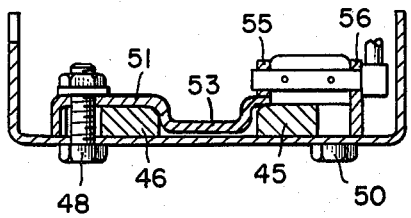
FIG. 10 is a cross sectional view taken along the line X—X in FIG. 9.
Figure 9:
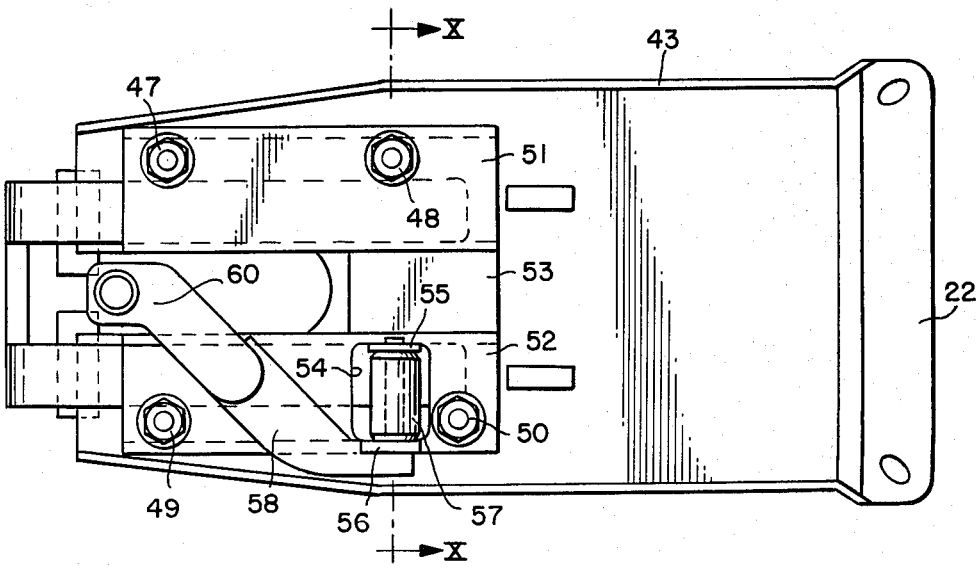
FIG. 9 is a bottom view of the seat depth adjusting means of FIG. 7, with parts removed for clarity.

As shown most clearly in FIGS. 9 and 10, the recesses are formed by two U-shaped rails 51, 52 which are connected together by a crosspiece 53. The U-shaped rail 52 is provided with an opening 54 on a bottom or floor facing side thereof, with two bent tabs 55, 56 which face each other, of the U-shaped rail 52 being mounted in the opening 54. A clamping or locking cylinder 55 rotatable about an eccentric shaft is mounted between the bent tabs 55, 56. A lever 58 is rigidly connected to the eccentric shaft of the cylinder 57. A compression spring 59 (FIG. 7) is braced against a back of the U-shaped rail 52 and the lever 58 so as to spring load the lever 58. The spring load of the compression spring 59 is directed in such a manner that the cylinder 57 is pressed firmly onto the backrest support bracket 45 of the backrest support member 44 and thus locks or clamps the backrest support member 44. By a pivoting of an extension handle 60, the compression spring 59 may be manually compressed and the eccentrically mounted clamping or locking cylinder 57 may be turned into a release position, whereupon the backrest support member 44 may be moved relative to the intermediate support member 43 and a depth of the seat may radially be adjusted.

Figure 11:
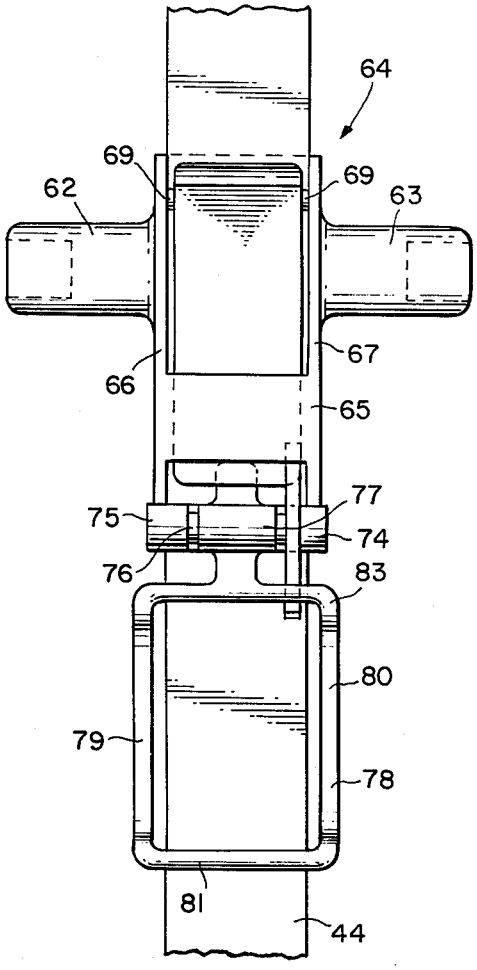
FIG. 11 is a front view of an infinitely variable backrest height adjusting means for the chair constructed in accordance with the present invention.
Figure 12:
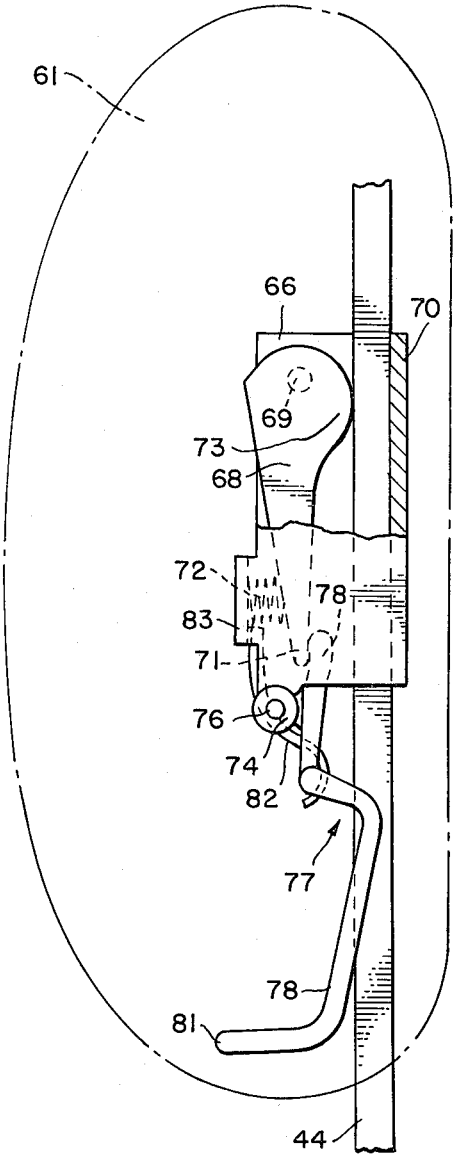
FIG. 12 is a partial cross sectional side view of the height adjusting means of FIG. 11.

FIGS. 11 and 12 provide yet another example of a chair of the present invention wherein the backrest support member 44 is formed as a profiled rod having mounted thereon an upholstered backrest member 61 which is adapted to be moved along the axial length of the rod for the purpose of providing an infinitely adjustable height for the upholstered backrest member 61. The upholstered backrest member 61 is mounted on pivot pins 62, 63 of a sliding core member generally designated by the reference numeral 64. The core member 64 includes a sleeve-like housing 65 having a square or rectangular cross section. The housing 65 includes spaced side walls 66, 67 for supporting the pivot pins 62, 63 and an eccentric 68, pivotable about a shaft 69, is mounted between the side walls 66, 67. The backrest support member 44 extends between the eccentric 68 and another wall 70 of the housing 65. The eccentric 68 includes an extended or projecting arm portion forming a handle 71, with the handle 71 being spring loaded by a coil compression spring 72 in a direction of the backrest support member 44 so as to press an enlarged part 73 of the eccentric 68 against the backrest support member 44. Two coaxially disposed hinge means 74, 75 are attached to the housing in a lower end thereof, with the hinge means 74, 75 being adapted to pivotally mount a shaft 76 on which a double-levered handle generally designated by the reference numeral 77 is mounted. The handle 77 includes an upper end 77' adapted to be disposed beneath an interlock or abut with the extension handle 71. A lower part of the handle 77 is formed as an angled wire loop 78 having side arms 79, 80 extending somewhat beyond the backrest support member 44 and terminating in a lower transverse bow 81.

A leaf spring 82 is provided for holding the handle 77 in the position illustrated in FIG. 12. An upper end of the leaf spring 82 rests under a front side wall 83 of the housing 65, with the leaf spring 82 then extending forwardly over the hinge means 74 and connecting or engaging the handle 77 behind an upper transverse bow 84 of the handle 77. When the lower transverse bow 81 of the handle 77 is depressed, the handle 71 of the eccentric 68 is lifted above the upper end 77' of the handle 77 and the enlarged part 73 of the eccentric 68 is removed from the backrest support member 44 so that the upholstered backrest member 61 may be adjusted to a desired height in a continuous process.

Figure 13:
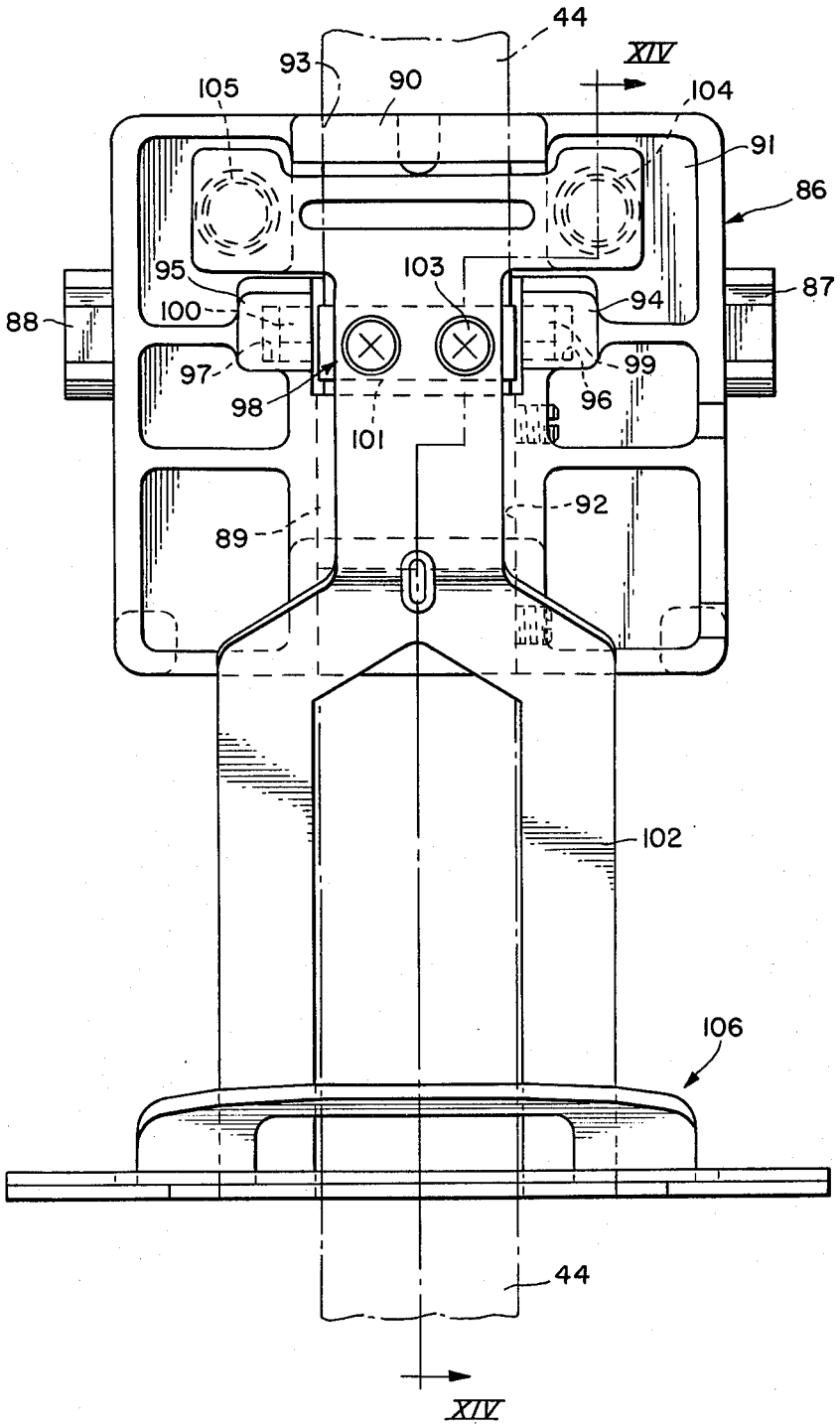
FIG. 13 is a rear view of another embodiment of an infinitely variable backrest height adjusting means for a chair constructed in accordance with the present invention.
Figure 14:
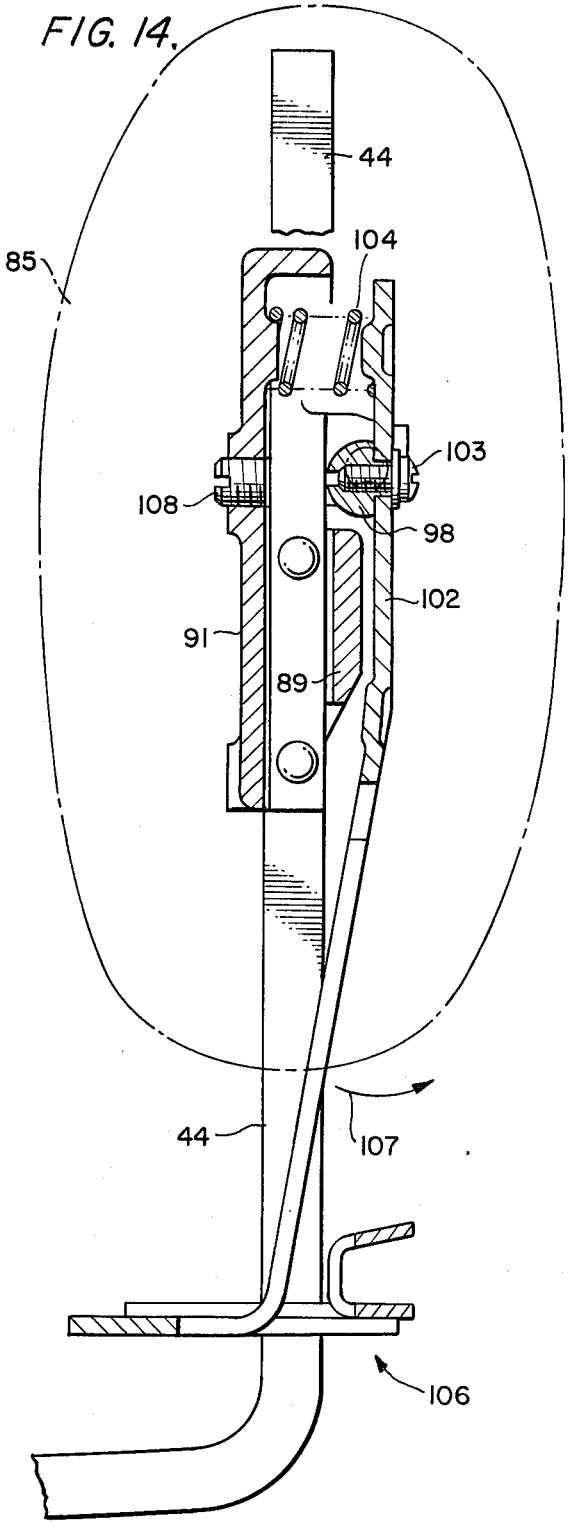
FIG. 14 is a cross sectional view taken along the line XIV—XIV in FIG. 13.
Figure 15:
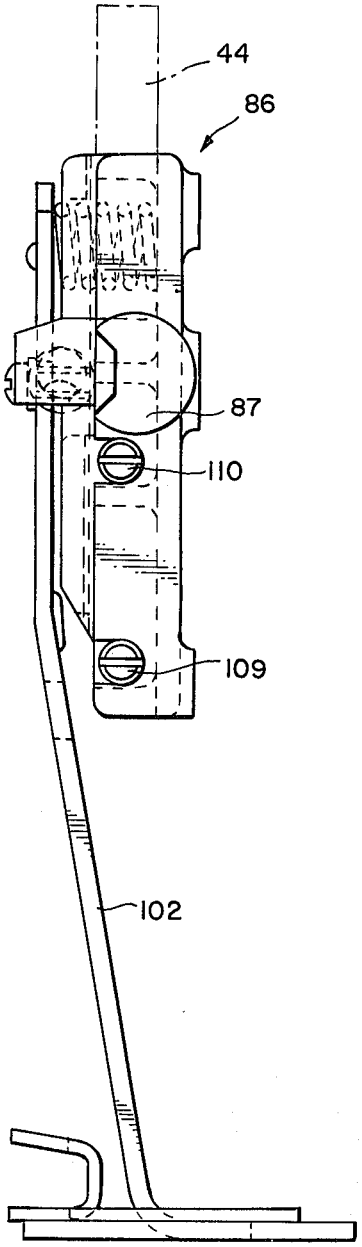
FIG. 15 is a side view of the height adjusting means of FIG. 13.

FIGS. 13–15 provide another example of a chair of the present invention with an infinitely adjustable height for a backrest member and, according to these figures, a backrest member 85 is mounted on a backrest support member 44 by a movable plate shaped slide block generally designated by the reference numeral 86. The slide block 86 is provided with a pair of laterally disposed pivot pins 87, 88 for enabling an attachment of the backrest member 85. The slide block 86 includes attached cross yokes 89, 90 in a center area and upper edge area thereof, with the cross yokes 89, 90 and base plate 91 forming coaxially arranged insertion channels 92, 93 for the backrest support member 44. Two projections are provided on the base plate 91 at a position between the insertion channels 92, 93, with two coaxial blind holes 96, 97 being respectively formed in the projections. The projections are disposed on both sides and forwardly of, as viewed in FIG. 13, a space occupied by the backrest support member 44. With the slide block 86 removed from the backrest support member 44, the blind holes 96, 97 are open toward a baseplate 91 to such an extent that an eccentric 98 and associated lateral bearing journals 99, 100, which are adapted to be set at an upwardly extending eccentric position, may be inserted into the blind holes 96, 97.

The eccentric 98 includes an enlarged cylindrically shaped center eccentric section 101 having threadably secured thereto a trigger lever by way of, for example, suitable fasteners such as screws 103. The trigger lever 102 is loaded on a top on both sides of the space for accommodating the backrest support member 44 by compression springs 104, 105 supported between the base plate 91 and trigger lever 102. The spring load of the compression springs 104, 105 is applied in such a manner that the eccentric 98 with its enlarged eccentric center section 101 is turned clockwise, as viewed in FIG. 14, and is pressed firmly against the backrest support member 44 so that the slide block 86 and thus the backrest member 85 are stopped or held at any desired adjusted height position.

The trigger lever 102 is forked in a lower area thereof and with some clearance encloses the backrest support member 44 with a lower handle frame generally designated by the reference numeral 106 in such a manner that the trigger lever 102 may be manually moved in a direction indicated by the arrow 107 in FIG. 14 around the bearing journals 99, 100, whereby the eccentric center section 101 may be lifted off the support member 44 for enabling a height adjustment. By way of fastening means such as, for example, screws 108, 109, 110, a pressure of the backrest support member 44 on the channels 92, 93 may be adjusted so as to enable a selection of the desired sliding resistance for the backrest support member 44.

While we have shown and described several embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as encompassed by the scope of the appended claims.

We claim:

1. A chair comprising a seat portion, a backrest portion, support means for supporting the seat portion, and a cylinder-piston means for enabling an adjustment of an inclination of the backrest portion with respect to the seat portion, characterized in that means are provided for mounting the seat portion at the support means so as to fix a normal setting of inclination between the seat portion and the backrest portion, first means are provided for mounting a first end of the cylinder-piston means to the backrest portion including a bearing shaft means, means are provided for mounting the bearing shaft means to the chair so as to enable the bearing shaft means to be easily removed including a threaded coupling comprising a threaded portion provided along at least a portion of an axial length of the bearing shaft means, and bearing sleeve means mounted in the chair and provided with an internal threaded portion cooperable with the threaded portion of the bearing shaft means, second means are provided for mounting a second end of the cylinder piston means to the chair including a coupling member extending transversely of the seat portion, the coupling member including a pair of axially spaced end portions, coaxially disposed bearing means are respectively provided in each of the end portions, bearing support means are accommodated in the bearing means, the coupling member further includes means for enabling a removal of the coupling member from the bearing support means after a removal of the bearing shaft means including a centrally disposed recess means provided between the end portions for removably accommodating the bearing support means, the coupling member has a substantially cylindrical cross-section and includes one substantially flat outer surface, the recess means is provided in the coupling member on a side thereof opposite the substantially flat surface, the bearing support means includes a pair of bearing pins respectively disposed in the bearing means in the end portion of the coupling member and in the recess means, each of the bearing pins has a substantially cylindrical cross section and includes one substantially flat outer surface, and in that the recess means are dimensioned such that the coupling member is removed from the bearing pins by rotation of the coupling member through a predetermined angle.

2. A chair according to claim 1, characterized in that the means for mounting the seat portion at the support means includes a fixed pivot means for enabling an inclination of the seat portion and backrest portion to be synchronously varied by a change in length of the cylinder-piston means.

3. A chair according to claim 2, characterized in that the seat portion includes a plate-shaped seat support member pivoted to the support means by the fixed pivot means, the support means includes a support plate adapted to be mounted on a pedestal, an intermediate support member arranged between the seat support member and the support plate, means are provided for movably connecting a front portion of the seat support member to a front edge of the intermediate support member, means are provided for pivotally mounting the intermediate support member to the support plate, and in that means are provided for connecting a rear end of the intermediate support member to the backrest portion.

4. A chair according to claim 3, characterized in that the first means for mounting further includes a bearing means provided on the cylinder-piston means, the bearing means being adapted to surround the bearing shaft means.

5. A chair according to one of claims 3 or 4, characterized in that means are provided for enabling an adjustment of the backrest portion so as to vary a seat depth, and in that means are provided for locking the backrest portion in a selected adjusted seat depth position.

6. A chair according to claim 5, characterized in that the backrest portion includes a backrest support member and a backrest member, means are provided for displaceably mounting the backrest member on the backrest support member for enabling a height adjustment of the backrest member, and in that means are provided for locking the backrest member in a selected height adjusted position.

7. A chair according to claim 6, characterized in that the bearing shaft means is mounted on the intermediate suport member, and in that the means for locking the backrest portion includes an eccentric means mounted on the intermediate support member, and means for manually operating the eccentric means so as to cause a selective locking of the backrest portion in adjusted positions.

8. A chair according to claim 7, characterized in that the means for displaceably mounting the backrest member includes a core member slidable along a backrest support member, and in that the means for locking the backrest support member includes a further eccentric means disposed on the core member for clamping the backrest support member against a portion of the core member in selected adjusted positions of the backrest member.

9. A chair according to one of claims 1 or 2, characterized in that means are provided for enabling an adjustment of the backrest portion so as to vary a seat depth, and in that means are provided for locking the backrest portion in a selected adjusted seat depth position.

10. A chair according to claim 9, characterized in that the backrest portion includes a backrest support member and a backrest member, means are provided for displacably mounting the backrest member on the backrest support member for enabling a height adjustment of the backrest member, and in that means are provided for locking the backrest member in a selected height adjusted position.

11. A chair according to one of claims 1 or 2, characterized in that the backrest portion includes a backrest support member, the support means includes a support plate adapted to be mounted on a pedestal and an intermediate support member arranged between the support plate and the seat portion, the bearing shaft means is mounted on the intermediate support member, means are provided for mounting the backrest support member at the intermediate support members so as to enable a seat depth adjustment, and in that means are provided for locking the backrest support member in a selected seat depth adjusted position.

12. A chair according to claim 11, characterized in that the backrest support member includes a pair of parallel support flanges enclosing the cylinder-piston means, the means for mounting the backrest support member includes guide means provided on the intermediate support member for guiding a movement of the parallel support flanges, the locking means includes a manually adjustable eccentric means adapted to clamp the backrest support member at the intermediate support member.

13. A chair according to claim 12, characterized in that the backrest support member further includes an upright support portion and a backrest member, means are provided for displacably mounting the backrest member on the upright support portion for enabling a height adjustment of the backrest member, and in that means are provided for clamping the backrest member in a selected height adjusted position.

14. A chair according to claim 13, characterized in that the means for clamping includes a further eccentric means mounted on the chair for enabling a clamping of the upright support member between an outer surface of the further eccentric means and a portion of the chair.

15. A chair according to claim 13, characterized in that the means for displacably mounting the backrest member on the upright support portion includes a sliding core means, and in that the means for clamping the backrest member includes a further eccentric means mounted on the core means, the further eccentric means is mounted on the core means in such a manner so as to enable a clamping of the upright support portion between an outer surface of the further eccentric means and an inner wall of the core means.

16. A chair according to claim 15, characterized in that the further eccentric means includes an extended portion forming an actuating lever means, means are provided for urging the eccentric means into engagement with the upright support portion, and in that a further lever means is mounted on the core means and cooperates with the actuating lever means for controlling a positioning of the eccentric means so as to enable an adjustment of the backrest member.

17. A chair according to claim 16, characterized in that the further lever means is a double lever pivotally mounted on the core means.

18. A chair according to claim 17, characterized in that means are provided on the core means for pivotally mounting the backrest member thereon.

19. A chair according to claim 15, characterized in that the manually adjustable eccentric means adapted to clamp the backrest support member includes a clamping guide cylinder mounted so as to be rotatable about an eccentric shaft, the guide means includes a pair of substantially U-shaped channel means secured to the intermediate support member for respectively accommodating the support flanges for the backrest support member, and in that means are provided on at least one of the channel means for mounting the clamping cylinder at the channel means.

20. A chair according to claim 19, characterized in that the means for mounting the clamping cylinder includes a pair of axially spaced tab means formed at an opening in the at least one channel means for supporting the eccentric shaft.

21. A chair according to one of claims 1 or 2, characterized in that the backrest portion includes a pair of L-shaped support flanges, and a backrest member displacably mounted on the support flanges, and in that means are provided for cooperating with at least one of the support flanges for clamping the at least one flange with respect to an adjacent portion of the chair so as to enable a locking of the backrest member in selected height adjusted positions.

22. A chair according to claim 21, characterized in that the means for clamping includes a pivotally mounted spring loaded eccentric means adapted to be pivoted out of a fixed position so as to enable a height adjustment of the backrest member.

23. A chair according to claim 1, characterized in that the backrest portion includes an upright support portion and a backrest member, means are provided for displaceably mounting the backrest member on the upright support portion so as to enable a height adjustment of the backrest member, and means for locking the backrest member in a selected height adjusted position, the means for locking the backrest member includes an eccentric means arranged on a portion of the means for displaceably mounting the backrest member so as to enable a clamping of the upright support portion between an outer surface of the eccentric means and a portion of the means for displaceably mounting the backrest member.

24. A chair according to claim 23, characterized in that the backrest portion further includes a backrest support member, means are provided for enabling an adjustment of the backrest support member so as to enable a seat depth adjustment, and in that means are provided for locking the backrest support member in a selected adjusted depth position.

25. A chair according to claim 24, characterized in that the backrest support member includes a pair of parallel support flanges, guide means are provided on the chair for guiding a movement of the support flanges, the means for locking the backrest support member includes a manually adjustable eccentric means adapted to clamp the backrest support member against a portion of the chair.

26. A chair according to claim 25, characterized in that the means for displacably mounting the backrest member on the upright support portion includes a sliding core means, the means for locking the backrest member includes an eccentric means mounted on the core means for enabling a clamping of the upright support portion between an outer surface of the eccentric means and an inner wall of the core means.

27. A chair according to claim 26, characterized in that the eccentric means includes an extended portion forming an actuating lever means, means are provided for urging the eccentric means into engagement with the upright support portion, and in that a further lever means is mounted on the core means and cooperates with the actuating lever means for controlling a positioning of the eccentric means so as to enable an adjustment of the backrest member.

28. A chair according to claim 23, characterized in that the means for displaceably mounting the backrest member includes a slide member displaceably mounted on the upright support portion, a first cross yoke means provided on a top edge of the slide member and a second cross yoke means disposed substantially in a center area of the slide member, the first and second cross yoke means including openings arranged so as to form with a portion of the slide member aligned channel means for accommodating the upright support portion, the locking means includes an eccentric means mounted on the slide member, lever means are provided for controlling a positioning of the eccentric means, and in that means are provided for normally urging the eccentric means into engagement with the upright support portion.

29. A chair according to claim 1, characterized in that the backrest support member includes a pair of parallel support flanges, guide means are provided on the chair for guiding a movement of the support flanges, the means for locking the backrest support member includes a manually adjustable eccentric means adapted to clamp the backrest support member against a portion of the chair.

30. A chair according to claim 29, characterized in that the manually adjustable eccentric means includes a clamping cylinder mounted so as to be rotatable about an eccentric shaft, the guide means includes a pair of substantially U-shaped channel means secured to the chair for respectively accommodating the support flanges of the backrest support member, and in that means are provided on at least one of the channel means for mounting the clamping cylinder at the channel means.

31. A chair according to claim 30, characterized in that the means for mounting the clamping cylinder includes a pair of axially spaced tab means formed at an opening in the at least one channel means for supporting the eccentric shaft.

32. A chair according to claim 1, characterized in that the cylinder-piston means includes a trigger means adapted to open a valve provided between two chambers of the cylinder-piston means.

33. A chair according to claim 32, characterized in that the recess means is provided between the end portions and a side opposite the cylinder-piston means for housing the trigger means.

34. A chair according to claim 33, characterized in that the bearing means each include a lateral opening provided at a side opposite the cylinder piston means for accommodating the coupling member.

* * * * *